US007956022B2

(12) United States Patent
Le Coent et al.

(10) Patent No.: US 7,956,022 B2
(45) Date of Patent: Jun. 7, 2011

(54) LOW SULFUR METAL DETERGENT-DISPERSANTS

(75) Inventors: Jean-Louis Le Coent, Le Havre (FR); Jeffrey J. Toman, Oakland, CA (US); Curtis B. Campbell, Hercules, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1418 days.

(21) Appl. No.: 11/192,757

(22) Filed: Jul. 29, 2005

(65) Prior Publication Data

US 2007/0027057 A1 Feb. 1, 2007

(51) Int. Cl.
*C10M 159/20* (2006.01)
*C10M 135/02* (2006.01)

(52) U.S. Cl. ..... 508/460; 508/331; 508/332; 508/518; 508/574

(58) Field of Classification Search ..... 508/460, 508/518, 574
See application file for complete search history.

(56) References Cited

U.S. PATENT DOCUMENTS

| | | | | |
|---|---|---|---|---|
| 2,256,443 | A | 9/1941 | Reiff | |
| 2,311,931 | A | 2/1943 | Cook et al. | |
| 2,366,873 | A | 1/1945 | Reiff | |
| 2,366,874 | A | 1/1945 | Reiff | |
| 3,410,798 | A | 11/1968 | Cohen | |
| 3,595,791 | A | 7/1971 | Cohen | |
| 6,001,785 | A * | 12/1999 | Le Coent et al. | 508/460 |
| 6,235,688 | B1 | 5/2001 | Small et al. | |
| 6,291,408 | B1 * | 9/2001 | Le Coent et al. | 508/460 |
| 6,348,438 | B1 * | 2/2002 | Le Coent et al. | 508/332 |
| 6,569,818 | B2 | 5/2003 | Nakazato et al. | |
| 6,642,190 | B2 * | 11/2003 | Hammond et al. | 508/460 |
| 6,784,143 | B2 * | 8/2004 | Locke et al. | 508/460 |
| 7,087,557 | B2 * | 8/2006 | Muir et al. | 508/460 |
| 7,163,911 | B2 * | 1/2007 | Boons et al. | 508/460 |
| 2005/0137098 | A1 * | 6/2005 | Le Coent et al. | 508/392 |
| 2005/0137100 | A1 * | 6/2005 | Le Coent et al. | 508/518 |
| 2007/0027043 | A1 * | 2/2007 | Le Coent | 508/460 |
| 2007/0027044 | A1 * | 2/2007 | Le Coent | 508/460 |

FOREIGN PATENT DOCUMENTS

| | | | |
|---|---|---|---|
| EP | 0 168 110 | A1 | 1/1986 |
| EP | 0 168 111 | A1 | 1/1986 |
| EP | 0 168 880 | A1 | 1/1986 |
| EP | 0 385 616 | B1 | 2/1990 |
| EP | 1 167 497 | A2 | 1/2002 |

* cited by examiner

*Primary Examiner* — Ellen M McAvoy

(57) ABSTRACT

A process for preparing alkylhydroxybenzoate detergent-dispersant additives having low sulfur content and high TBN is described. The alkali metal alkylhydroxylbenzoate, alkaline earth metal alkylhydroxybenzoate and overbased alkaline earth metal alkylhydroxybenzoate reaction products described have a sulfur content in the range of from about 0.1 to 1.2 wt % are effective anti-corrosive detergent-dispersant additives in lubricating oil compositions.

67 Claims, No Drawings

LOW SULFUR METAL DETERGENT-DISPERSANTS

The present invention relates to a process for the preparation of novel detergent-dispersant additives having a low sulfur content and high TBN which are favorably employed in lubricating oil compositions for internal combustion engines.

BACKGROUND OF THE INVENTION

Detergent additives have been used for decades as components of lubricating oil compositions. In recent years, however, there has been an increasing interest in the use of hydroxyaromatic carboxylate salts, especially salicylates, as essential components of so-called "low SAPs" (Sulfur/Ash/Phosphorus) automotive engine oil lubricants. For example, U.S. Pat. No. 6,569,818 discloses low sulfur, phosphorus and sulfated ash content lubricating oil compositions containing non-sulfurized alkali metal or alkaline earth metal salts of an alkylsalicylic acid.

In addition to the non-sulfurized alkali metal or alkaline earth metal salts taught in U.S. Pat. No. 6,569,818, sulfur-containing hydroxyaromatic carboxylate compositions are also known.

U.S. Pat. No. 2,311,931 discloses metal salts of alkyl or cycloalkyl salicylates sulfides having both excellent detergent and excellent anti-corrosive action when dispersed in lubricating oils and thereby having a single additive effective to inhibit corrosion, sludge and varnish formation, ring sticking and other difficulties experienced in lubricating oils serving in a heavy duty capacity.

U.S. Pat. No. 2,256,443 discloses a sulfide of an alkyl-substituted hydroxyaromatic carboxylic acid salt having increased pour depressant and viscosity index improving properties. The improved antioxidant properties are particularly significant in retarding the development of acidity in certain types of oils and under certain conditions of use.

U.S. Pat. No. 2,366,873 discloses a sulfide of an alkyl-substituted aryl metal oxide. These sulfides of alkylated aryl metal oxides are characterized by the presence of at least two aromatic nuclei, in which the oxygen of the metal oxide group is attached to the aryl nucleus, which are interconnected by at least one atom of an element selected from the group consisting of sulfur, selenium and tellurium. The compounds exhibit increased effectiveness in retarding the deleterious effects of oxidation in lubricating oil.

U.S. Pat. No. 2,366,874 discloses a metal salt of an alkylated hydroxyaromatic (phenol) sulfide. This compound is a condensation product of an alkyl-substituted aryl metal oxide in which the oxygen of the metal oxide group is directly attached to the aryl nucleus and in which at least two alkyl-substituted aryl nuclei are interconnected by at least one atom of sulfur.

U.S. Pat. No. 3,410,798 discloses basic metal salts of phenol or salicylic acid sulfides prepared by reacting a phenol or salicylic acid, or a salt thereof, with sulfur and an alkaline earth base at a temperature of about 150° to 200° C., in the presence of a carboxylic acid salt thereof and a polyalkylene glycol or alkylene or polyalkylene glycol alkyl ether. The products are useful as detergent additives for lubricants.

U.S. Pat. No. 3,595,791 discloses basic metal salts of salicylic acid sulfides prepared by reacting salicylic acid, or a salt thereof, with sulfur and an alkaline earth base at a temperature of about 150° to 250° C., in the presence of an alkylene or polyalkylene glycol or a monoether thereof. The products are useful as detergent additives for lubricants.

U.S. Pat. No. 6,235,688 discloses sulfurized phenates, sulfurized salicylates, salts of sulfurized multi-hydroxyl aromatic compounds and chemical and physical mixtures thereof.

European Patent Publication Number 0168111 discloses sulfurized metal aliphatic hydrocarbon-substituted salicylates, characterized in that an aliphatic hydrocarbon-substituted phenol is sulfurized and the resulting product is transformed into an alkali metal salicylate with an alkali metal hydroxide and carbon dioxide.

European Patent Publication Number 0168110 discloses sulfurized overbased, metal aliphatic hydrocarbon-substituted salicylates by sulfurization of an aliphatic hydrocarbon-substituted salicylic acid or a metal salt thereof with a sulfur halide, and subsequently by transforming the reaction product into an overbased metal salicylate.

European Patent Publication Number 0168880 discloses sulfurized overbased, metal aliphatic hydrocarbon-substituted salicylates, characterized in that an aliphatic hydrocarbon-substituted salicylic acid is transformed into overbased metal salicylate having a basicity index of at least 1.5 by means of a basic metal compound and with carbon dioxide, and subsequently the overbased metal salicylate is sulfurized by heating with elemental sulfur.

The above references, however, teach hydroxyaromatic carboxylate compositions containing relatively high levels of sulfur, which are not desirable in formulating low SAPS oils. Sulfur contained in the fuel or lubricating oil is converted to sulfuric acid and sulfates which are often corrosive. Hence, the need for low levels of sulfur. However, it is often difficult to achieve low sulfur content levels without compromising the effectiveness of detergent additives in the fuel or lubricating oil. Effective low sulfur detergents are therefore highly desirable.

SUMMARY OF THE INVENTION

It has now been discovered that a low sulfur detergent-dispersant additive having high TBN can be achieved that provides little to no corrosion.

Accordingly, the present invention relates to a process for the preparation of a novel detergent-dispersant additive having a low sulfur content which is favorably employed in lubricating oil compositions for internal combustion engines. More particularly, the present invention relates to a process for the preparation of alkylhydroxybenzoate reaction products, characterized in that the sulfur content ranges from about 0.1 to 1.2 wt % in the alkylhydroxybenzoate reaction product.

In one embodiment, the present invention relates to a process for preparing an alkali metal alkylhydroxybenzoate reaction product comprising the steps of:

a) neutralizing at least one alkylphenol with an alkali metal base to form an alkali metal alkylphenate; and b) carboxylating the alkali metal alkylphenate with carbon dioxide to obtain an alkali metal alkylhydroxybenzoate reaction product;

wherein at least one of the alkylphenol, alkylphenate and alkylhydroxybenzoate is reacted with a sulfur source to achieve a sulfur content in the range of about 0.1 to 1.2 wt % in the alkali metal alkylhydroxybenzoate reaction product, and wherein at least 50 mole % of the starting alkylphenol is converted to the alkali metal alkylhydroxybenzoate reaction product.

In another embodiment, the present invention relates to a process for preparing an alkaline earth metal alkylhydroxybenzoate reaction product comprising the steps of:

a) neutralizing at least one alkylphenol with an alkali metal base to form an alkali metal alkylphenate;

b) carboxylating the alkali metal alkylphenate with carbon dioxide to obtain an alkali metal alkylhydroxybenzoate; and c) acidifying the alkali metal alkylhydroxybenzoate to form the alkylhydroxybenzoic acid, and further reacting the alkylhydroxybenzoic acid with a molar excess of an alkaline earth metal base to form an alkaline earth metal alkylhydroxybenzoate reaction product;

wherein at least one of the alkylphenol, alkylphenate, alkylhydroxybenzoic acid, alkali metal alkylhydroxybenzoate and alkaline earth metal alkylhydroxybenzoate is reacted with a sulfur source to achieve a sulfur content in the range of about 0.1 to 1.2 wt % in the alkaline earth metal alkylhydroxybenzoate reaction product, and wherein at least 50 mole % of the starting alkylphenol is converted to the alkaline earth metal alkylhydroxybenzoate reaction product.

In yet another embodiment, the present invention relates to a process for preparing an overbased alkaline earth metal alkylhydroxybenzoate reaction product obtained by a process comprising the steps of:

a) neutralizing at least one alkylphenol with an alkali metal base to form an alkali metal alkylphenate;

b) carboxylating the alkali metal alkylphenate with carbon dioxide to obtain an alkali metal alkylhydroxybenzoate;

c) acidifying the alkali metal alkylhydroxybenzoate to form the alkylhydroxybenzoic acid, and further reacting the alkylhydroxybenzoic acid with an alkaline earth metal base to form an alkaline earth metal alkylhydroxybenzoate; and d) overbasing the alkaline earth metal alkylhydroxybenzoate with an alkaline earth metal base and at least one acidic overbasing material to form an overbased alkaline earth metal alkylhydroxybenzoate reaction product;

wherein at least one of the alkylphenol, alkylphenate, alkylhydroxybenzoic acid, alkali metal alkylhydroxybenzoate and alkaline earth metal alkylhydroxybenzoate, or overbased derivatives thereof is reacted with a sulfur source to achieve a sulfur content in the range of about 0.1 to 1.2 wt % in the overbased alkaline earth metal alkylhydroxybenzoate reaction product, and wherein at least 50 mole % of the starting alkylphenol is converted to the overbased alkaline earth metal alkylhydroxybenzoate reaction product.

In still another embodiment, the present invention relates to lubricating oil compositions employing the alkali metal alkylhydroxybenzoate reaction product, the alkaline earth metal alkylhydroxybenzoate reaction product or the overbased alkaline earth metal alkylhydroxybenzoate reaction product, prepared by the respective processes of the present invention described above, with a major amount of base oil of lubricating viscosity.

Alternatively, the present invention relates to the product prepared by any one of the above processes.

Among other things the present invention provides for a process of producing low sulfur, high TBN detergent-dispersant additives, namely alkylhydroxybenzoate reaction products, that exhibit little to no corrosion in the lubrication of mechanical components of internal combustion engines when employed as detergent-dispersant additives in lubricating oil compositions. The lubricating oil compositions employing the detergent-dispersant additives of the present invention are, thus, useful in improving anti-corrosion properties in internal combustion engines operating with such lubricating oil compositions.

DETAILED DESCRIPTION OF THE INVENTION

Prior to discussing the present invention in detail, the following terms will have the following meanings unless expressly stated to the contrary.

Definitions

The term "alkali metal" or "alkaline metal" refers to lithium, sodium or potassium, with potassium being preferred.

The term "alkaline earth metal" refers to calcium, barium, magnesium and strontium, with calcium being preferred.

The term "alkyl" refers to both straight- and branched-chain alkyl groups.

The term "alkylphenate" means a metal salt of an alkylphenol.

The term "alkylphenol" means a phenol having one or more alkyl substituents, wherein at least one of the alkyl substituents has a sufficient number of carbon atoms to impart oil solubility to the phenol.

The term "aryl group" is a substituted or non-substituted aromatic group, such as the phenyl, tolyl, xylyl, ethylphenyl and cumenyl groups.

The term "calcium base" refers to a calcium hydroxide, calcium oxide, calcium alkoxides, and the like, and mixtures thereof.

The term "hydrocarbyl" means an alkyl or alkenyl group.

The term "hydrocarbyl phenol" refers to a phenol having one or more hydrocarbyl substituents; at least one of which has sufficient number of carbon atoms to impart oil solubility to the phenol.

The term "lime" refers to calcium hydroxide, also known as slaked lime or hydrated lime.

The term "metal" means alkali metals, alkaline earth metals, or mixtures thereof.

The term "metal base" refers to a metal hydroxide, metal oxide, metal alkoxides and the like and mixtures thereof, wherein the metal is selected from the group consisting of lithium, sodium, potassium, magnesium, calcium, strontium, barium or mixtures thereof.

The term "overbased" refers a class of metal salts or complexes. These materials have also been referred to as "basic", "superbased", "hyperbased", "complexes", "metal complexes", "high-metal containing salts", and the like. Overbased products are metal salts or complexes characterized by a metal content in excess of that which would be present according to the stoichiometry of the metal and the particular acidic organic compound reacted with the metal, e.g., a carboxylic acid.

The term "phenate" means a metal salt of a phenol.

The term "salicylate" means a metal salt of a salicylic acid.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D 2896 or equivalent procedure.

The present invention relates to a process for preparing an alkylhydroxybenzoate reaction product having low sulfur content favorably employed in lubricating oil compositions for internal combustion engines. Typically, the alkylhydroxybenzoate reaction product will have a sulfur content from about 0.1 to 1.2 wt % sulfur, more preferably about 0.1 to 1.0 wt % sulfur, and most preferably about 0.1 to 0.5 wt % sulfur in the alkylhydroxybenzoate reaction product of the present invention.

Alkylhydroxybenzoate Reaction Product

Alkali Metal Alkylhydroxybenzoate Reaction Product

In a first embodiment, an alkali metal alkylhydroxybenzoate reaction product of the present invention may be prepared by the following process.

A. Formation of the Alkali Metal Base Alkylphenate

In the first step, at least one alkylphenol is neutralized using an alkali metal base in the presence of suitable solvent such as aliphatic hydrocarbons, e.g. toluene, xylene, light alkylbenzene or the light. In one embodiment, the solvent forms an azeotrope with water. In another embodiment, the solvent may also be a mono-alcohol such as 2-ethylhexanol. In this case, the 2-ethylhexanol is eliminated by distillation before carboxylation.

The alkylphenol may contain up to 98 wt % linear alkyl groups, up to 100 wt % branched alkyl groups, or both linear and branched alkyl groups. Preferably, the linear alkyl group, if present, is alkyl, and the linear alkyl group contains from about 12 to 40 carbon atoms, preferably from about 20 to 40 carbon atoms and more preferably from about 22 to 30 carbon atoms. The branched alkyl group, if present, is preferably alkyl and contains at least 9 carbon atoms, preferably from about 9 to 24 carbon atoms and more preferably from about 10 to 18 carbon atoms. In one embodiment, the alkylphenol contain up to 85 wt % of linear alkylphenol (preferably at least 35 wt % linear hydrocarbyl phenol) in mixture with at least 15 wt % of branched alkylphenol.

The use of an alkylphenol containing up to at least 35 wt % of long linear alkylphenol (from about 18 to 30 carbon atoms) is particularly attractive because a long linear alkyl chain promotes the compatibility and solubility of the additives in lubricating oils. However, the presence of relatively heavy linear alkyl groups in the alkylphenols makes the latter less reactive than branched alkylphenols, hence the need to use harsher reaction conditions to bring about their neutralization by an alkaline-earth metal base.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively reactive towards an alkaline-earth metal base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, meta, and para positions is much more uniformly distributed. This makes them much less reactive towards an alkaline-earth metal base since the phenol function is much less accessible due to considerable steric hindrance, due to the presence of closer and generally heavier alkyl substituents. Of course, linear alkylphenols may contain alkyl substituents with some branching which increases the amount of para substituents and, resultantly, increases the relative reactivity towards alkaline earth metal bases.

When the alkylphenol represents a mixture of aliphatic groups, the alkylhydroxybenzoate reaction product of the present invention may contain a mixture of linear alkyl groups, a mixture of branched alkyl groups, or a mixture of linear and branched alkyl groups. Thus, the alkylphenol can be a mixture of linear aliphatic groups, preferably alkyl; for example, an alkyl group selected from the group consisting of linear $C_{14}$-$C_{16}$, $C_{16}$-$C_{18}$, $C_{18}$-$C_{20}$, $C_{20}$-$C_{22}$, $C_{20}$-$C_{24}$ and $C_{20}$-$C_{28}$ alkyl and mixtures thereof. Advantageously, these mixtures include at least 95 mole %, preferably 98 mole % of alkyl groups and originating from the polymerization of ethylene.

The alkylhydroxybenzoate reaction product of the present invention, having a mixture of alkyl groups, can be prepared from linear alpha olefin cuts, such as those marketed by Chevron Phillips Chemical Company under the names Normal Alpha Olefin $C_{26}$-$C_{28}$ or Normal Alpha Olefin $C_{20}$-$C_{24}$, by British Petroleum under the name $C_{20}$-$C_{26}$ Olefin, by Shell Chimie under the name SHOP C20-C22, or mixtures of these cuts or olefins from these companies having from about 20 to 28 carbon atoms.

The alkali metal bases that can be used for carrying out this step include the oxides or hydroxides of lithium, sodium or potassium. In a preferred embodiment, potassium hydroxide is preferred.

An objective of this step is to have an alkylphenate having less than 2000 ppm, preferably less than 1000 ppm and more preferably less than 500 ppm of water.

This operation is carried out at a temperature high enough to eliminate water. In one embodiment, the product is put under a slight vacuum in order to utilize a lower reaction temperature.

The neutralization operation is carried out at a temperature of at least 120° C. preferably at least 130° C. and more preferably at least 135° C. for about 3 hours. In one embodiment, when xylene is used as the solvent, the reaction is conducted at a temperature between 130° C. and 155° C., under an absolute pressure of 800 mbar ($8\times10^4$ Pa).

In another embodiment, when 2-ethylhexanol is used as the solvent, the reaction is conducted at a temperature of at least 160° C., as the boiling point of 2-ethylhexanol (184° C.) is significantly higher than xylene (140° C.).

The pressure is reduced gradually below atmospheric in order to complete the distillation of water reaction. Preferably, the pressure is reduced to no more than 7000 Pa (70 mbar).

By providing that operations are carried out at a sufficiently high temperature and that the pressure in the reactor is reduced gradually below atmospheric, the neutralization reaction is carried out without the need to add a solvent and forms an azeotrope with the water formed during this reaction. In this case, temperature is heated up to 200° C. and then the pressure is reduced gradually below atmospheric. Preferably, the pressure is reduced to no more than 7000 Pa (70 mbar).

Elimination of water is done over a period of at least 2 hours, preferably at least 3 hours.

The quantities of reagents used correspond to the following molar ratios:

Alkali metal base:alkylphenol from about 0.8:1 to 1.2:1, preferably from about 0.9:1 to 1.05:1.

Sulfur:alkylphenol from about 0.03:1 to 1:1, preferably from about 0.07:1 to 0.5:1, more preferably from about 0.08:1 to 0.3:1.

Solvent: alkylphenol (wt:wt) from about 0.1:1 to 5:1, preferably from about 0.5:1 to 3:1.

B. Carboxylation

The alkylphenate prepared is then carboxylated by simply bubbling carbon dioxide into the reaction medium originating from the preceding neutralization step and is continued until at least 50 mole %, preferably 70 mole %, more preferably 80 mole % and most preferably 90 mole %, of the starting alkylphenol has been converted to alkali metal alkylhydroxybenzoate reaction product (measured as salicylic acid by potentiometric determination) at a temperature between about 120° C. and 180° C., under a pressure within the range of from about above atmospheric pressure to $5\times10^5$ Pa (5 bars) for a period of from about 2 to 8 hours. It must take place under pressure in order to avoid any decarboxylation of the alkali metal alkylhydroxybenzoate that forms.

In one variant with potassium salt, the temperature is preferably between about 125° C. and 165° C., more preferably about 130° C. to 155° C. and the pressure is from about atmospheric to 10 bars ($10\times10^5$ Pa), preferably from about atmospheric to 3.5 bars.

In another variant with sodium salt, the temperature is directionally lower, preferably from about 110° C. to 155° C. Most preferably from about 120° C. to 140° C. and the pressure from about 1 bar to 20 bars, preferably from about 3.5 bars to 15 bars.

The carboxylation is usually carried out, diluted in a solvent such as hydrocarbons or alkylate, e.g., benzene, toluene, xylene and the like. In this case, the weight ratio of solvent: hydroxybenzoate is from about 0.1:1 to 5:1, preferably from about 0.4:1 to 3:1.

In one variant, no solvent is used. In this case carboxylation is conducted in presence of diluent oil in order to avoid a too viscous material.

The weight ratio of diluent oil:hydroxybenzoate is from about 0.1:1 to 2:1, preferably from about 0.2:1 to 1:1 and more preferably from about 0.2:1 to 0.5:1.

To achieve a sulfur content in the range of about 0.1 to 1.2 wt %, preferably about 0.1 to 1.0 wt %, more preferably about 0.1 to 0.5 wt %, in the alkali metal alkyhydroxybenzoate reaction product, at least one of the alkylphenol, alkylphenate and alkylhydroxybenzoate is reacted with a sulfur source that readily provides sufficient sulfur such as elemental sulfur or sulfur halides as, for example, sulfur chloride ($S_2Cl_2$), sulfur di-chloride ($SCl_2$) or thionyl chloride ($SOCl_2$). Preferably, the sulfur source is elemental sulfur. The formation of the low sulfurized alkali metal alkylhydroxybenzoate reaction product is obtained with reaction of at least one of the alkylphenol, alkylphenate and alkylhydroxybenzoate with, for example, elemental sulfur from a temperature of about 150° C. to 230° C. for a period of about 0.5 to 4 hours, preferably from about 180° C. to 210° C. for a period from about 1 to 3 hours.

Preferably, the alkali metal alkylhydroxybenzoate reaction product of the present invention has a TBN from about 50 to 250, more preferably from about 70 to 200 and most preferably from about 100 to 150.

Alkaline Earth Metal Alkylhydroxybenzoate Reaction Product

In a second embodiment, the alkali metal alkylhydroxybenzoate prepared by the steps of A and B above is further reacted with a molar excess of an alkaline earth metal base to form an alkaline earth metal alkylhydroxybenzoate reaction product according to step C described in the following.

C. Acidification

The objective of this step is to acidify the alkali metal alkylhydroxybenzoate salt diluted in the solvent to give an alkylhydroxybenzoic acid. Any acid stronger than alkylhydroxybenzoic acid could be utilized. Usually aqueous hydrochloric acid or aqueous sulfuric acid is utilized.

The acidification step is conducted with an $H^+$ equivalent excess of acid versus hydroxybenzoic (salicylic) of at least 5 H+ equivalent %, preferably 10 H+ equivalent %, and more preferably 20 H+ equivalent %.

In one embodiment, sulfuric acid is used. It is diluted to about 5% to 50%, preferably about 10% to 30%. The quantity of sulfuric acid used versus hydroxybenzoate (salicylate), on a per mole of hydroxybenzoate basis, is at least 0.525 mole, preferably 0.55 mole and more preferably 0.6 mole of sulfuric acid.

The acidification reaction is carried out under agitation with any suitable mixing system at a temperature from about room temperature to 120° C., preferably from about 50° C. to 80° C., at a period from about 15 minutes to 300 minutes, preferably from about 60 minutes to 180 minutes.

At the end of this period of time, the agitation is stopped in order to allow good phase separation before the aqueous phase is separated.

To achieve a sulfur content in the range of about 0.1 to 1.2 wt %, preferably about 0.1 to 1.0 wt %, more preferably about 0.1 to 0.5 wt %, in the alkaline earth metal alkyhydroxybenzoate reaction product, at least one of the alkylphenol, alkylphenate, alkylhydroxybenzoic acid and alkylhydroxybenzoate is reacted with a sulfur source as described above for the first embodiment.

Preferably, the alkaline metal alkylhydroxybenzoate reaction product of the present invention has a TBN from about 50 to 250, more preferably from about 70 to 200 and most preferably from 100 to 150.

Overbased Alkaline Earth Metal Alkylhydroxybenzoate Reaction Product

In a third embodiment, the alkaline earth metal alkylhydroxylbenzoate prepared by the steps of A through C above is further overbased with at least one acidic overbasing material to form an overbased alkaline earth metal alkylhydroxybenzoate reaction product according to step D described in the following.

D. Overbasing:

Overbasing of the alkaline earth metal alkylhydroxybenzoate reaction product may be carried out by any method known by a person skilled in the art to produce an overbased alkaline earth metal alkylhydroxybenzoate reaction product. Generally, the overbasing reaction is carried out in a reactor in the presence of diluent oil, an aromatic solvent and an alcohol. The reaction mixture is agitated and alkaline earth metal and at least one acidic overbasing material such as carbon dioxide are added to the reaction while maintaining the temperature between about 20° C. and 80° C.

The degree of overbasing may be controlled by the quantity of the alkaline earth metal, at least one acidic overbasing material such as carbon dioxide and the reactants added to the reaction mixture and the reaction conditions used during the carbonation process.

The ratios of reagents used (methanol, xylene, slaked lime and $CO_2$) will correspond to the following weight ratios:

Xylene:slaked lime from about 2:1 to 7:1, preferably from about 2:1 to 4:1.

Methanol:slaked lime from about 0.25:1 to 3:1, preferably from about 0.4:1 to 1.2:1.

Carbon dioxide:slaked lime from about 0.5:1 to 1.3:1, preferably from about 0.7:1 to 1.0:1.

The alkaline earth metal alkylhydroxybenzoate reaction product is then overbased with an alkaline earth metal base to form the overbased alkaline earth metal alkylhydroxybenzoate reaction product of the present invention. Alkaline earth metals such as barium, calcium, magnesium and strontium are preferred. Calcium hydroxide or oxide is preferred.

Preferably, lime is added as a slurry, i.e., as a pre-mixture of lime, methanol, xylene, and $CO_2$ is introduced over a period of 1 hour to 4 hours, at a temperature between about 20° C. and 65° C.

To achieve a sulfur content in the range of about 0.1 to 1.2 wt %, preferably about 0.1 to 1.0 wt %, more preferably about 0.1 to 0.5 wt %, in the overbased alkaline earth metal alkyhydroxybenzoate reaction product, at least one of the alkylphenol, alkylphenate, alkylhydroxybenzoic acid and alkylhydroxybenzoate or overbased derivatives thereof is reacted with a sulfur source as described above for the first embodiment.

Optionally, for each of the processes described above, predistillation, centrifugation and distillation may be utilized to remove solvent and crude sediment. Water, methanol and a portion of the xylene may be eliminated by heating between 110° C. to 134° C. This may be followed by centrifugation to eliminated unreacted lime. Finally, xylene may be eliminated by heating under vacuum in order to reach a flash point of at least about 160° C. as determined with the Pensky-Martens Closed Cup (PMCC) Tester described in ASTM D93.

Preferably, the overbased alkaline earth metal alkylhydroxybenzoate of the present invention has a TBN from about 20 to 500, more preferably from about 100 to 400 and most preferably from about 150 to 300.

Lubricating Oil Composition

The present invention also relates to lubricating oil compositions containing the alkylhydroxybenzoate reaction products of the present invention.

The lubricating oil composition of the present invention may comprise a major amount of a base oil of lubricating viscosity and a minor amount of an alkali metal alkylhydroxybenzoate reaction product obtained by a process comprising the steps of:

a) neutralizing at least one alkylphenol with an alkali metal base to form an alkali metal alkylphenate; and b) carboxylating the alkali metal alkylphenate with carbon dioxide to obtain an alkali metal alkylhydroxybenzoate reaction product;

wherein at least one of the alkylphenol, alkylphenate and alkylhydroxybenzoate is reacted with a sulfur source to achieve a sulfur content in the range of about 0.1 to 1.2 wt % in the alkali metal alkylhydroxybenzoate reaction product, and wherein at least 50 mole % of the starting alkylphenol is converted to the alkali metal alkylhydroxybenzoate reaction product.

The lubricating oil composition of the present invention may also comprise a major amount of a base oil of lubricating viscosity and a minor amount of an alkaline earth metal alkylhydroxybenzoate reaction product obtained by a process comprising the steps of:

a) neutralizing at least one alkylphenol with an alkali metal base to form an alkylphenate;

b) carboxylating the alkylphenate with carbon dioxide to obtain an alkali metal alkylhydroxybenzoate; and c) acidifying the alkali metal alkylhydroxybenzoate to form the alkylhydroxybenzoic acid, and further reacting the alkylhydroxybenzoic acid with a molar excess of an alkaline earth metal base to form an alkaline earth metal alkylhydroxybenzoate reaction product;

wherein at least one of the alkylphenol, alkylphenate, alkylhydroxybenzoic acid, alkali metal alkylhydroxybenzoate and alkaline earth metal alkylhydroxybenzoate is reacted with a sulfur source to achieve a sulfur content in the range of about 0.1 to 1.2 wt % in the alkaline earth metal alkylhydroxybenzoate reaction product, and wherein at least 50 mole % of the starting alkylphenol is converted to the alkaline earth metal alkylhydroxybenzoate reaction product.

The lubricating oil composition of the present invention may further comprise a major amount of a base oil of lubricating viscosity and a minor amount of an overbased alkaline earth metal alkylhydroxybenzoate reaction product obtained by a process comprising the steps of:

a) neutralizing at least one alkylphenol with an alkali metal base to form an alkali metal alkylphenate;

b) carboxylating the alkali metal alkylphenate with carbon dioxide to obtain an alkali metal alkylhydroxybenzoate;

c) acidifying the alkali metal alkylhydroxybenzoate to form the alkylhydroxybenzoic acid, and further reacting the alkylhydroxybenzoic acid with an alkaline earth metal base to form an alkaline earth metal alkylhydroxybenzoate; and d) overbasing the alkaline earth metal alkylhydroxybenzoate with an alkaline earth metal base and at least one acidic overbasing material to form an overbased alkaline earth metal alkylhydroxybenzoate reaction product;

wherein at least one of the alkylphenol, alkylphenate, alkylhydroxybenzoic acid, alkali metal alkylhydroxybenzoate and alkaline earth metal alkylhydroxybenzoate or overbased derivatives thereof is reacted with a sulfur source to achieve a sulfur content in the range of about 0.1 to 1.2 wt % in the overbased alkaline earth metal alkylhydroxybenzoate reaction product, and wherein at least 50 mole % of the starting alkylphenol is converted to the overbased alkaline earth metal alkylhydroxybenzoate reaction product.

Base Oil of Lubricating Viscosity

Base oil as used herein is defined as a base stock or blend of base stocks which is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100° Centigrade (° C.) and about 4 centistokes (cSt) to about 20 cSt. Hydrocarbon synthetic oils may include, for example, oils prepared from the polymerization of ethylene, polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity about 20 cSt or higher at about 100 C. Oils used as the base oil will be selected or blended depending on the desired end use and the additives in the finished oil to give the desired grade of engine oil, e.g. a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Saturates levels and viscosity indices for Group I, II and III base oils are listed in Table I. Group IV base oils are polyalphaolefins (PAO). Group V base oils include all other base oils not included in Group I, II, III, or IV. Group III base oils are preferred.

TABLE I

Saturates, Sulfur and Viscosity Index of Group I, II, III, IV and V Base Stocks

| Group | Saturates (As determined by ASTM D2007) Sulfur (As determined by ASTM D2270) | Viscosity Index (As determined by ASTM D4294, ASTM D4297 or ASTM D3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |
| IV | All Polyalphaolefins (PAOs) | |
| V | All others not included in Groups I, II, III, or IV | |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil.

Such wax isomerate oil is produced by the hydroisomerization of natural or synthetic waxes or mixtures thereof over a hydroisomerization catalyst.

It is preferred to use a major amount of base oil in the lubricating oil composition of the present invention. A major amount of base oil as defined herein comprises 40 wt % or more. Preferred amounts of base oil comprise about 40 wt % to about 97 wt %, preferably greater than about 50 wt % to about 97 wt %, more preferably about 60 wt % to about 97 wt % and most preferably about 80 wt % to about 95 wt % of the lubricating oil composition. (When weight percent is used herein, it is referring to weight percent of the lubricating oil unless otherwise specified.)

The amount of alkylhydroxybenzoate reaction product of the present invention in the lubricating oil composition will be in a minor amount compared to the base oil of lubricating viscosity. Generally, it will be in an amount from about 1 to 15 wt %, preferably from about 2 tol 2 wt % and more preferably from about 3 to 8 wt %, based on the total weight of the lubricating oil composition.

The lubricating oil compositions according to the present invention will have a TBN from about 5 to 80, preferably from about 10 to 70 and more preferably from about 15 to 50.

Other Additive Components

The following additive components are examples of components that can be favorably employed in combination with the lubricating additive of the present invention. These examples of additives are provided to illustrate the present invention, but they are not intended to limit it.

(A) Ashless dispersants: alkenyl succinimides, alkenyl succinimides modified with other organic compounds, and alkenyl succinimides modified with boric acid, alkenyl succinic ester.

(B) Oxidation inhibitors:

1) Phenol type phenolic) oxidation inhibitors: 4,4'-methylenebis (2,6-di-tert-butylphenol),4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis (3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4 (N.N'dimethylaminomethylphenol),4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyldithiocarbamate).

(C) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(D) Demulsifiers: addition product of alkylphenol and ethyleneoxide, polyoxyethylene alkyl ether, and polyoxyethylene sorbitane ester.

(E) Extreme pressure agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(F) Friction modifiers: fatty alcohol, fatty acid, amine, borated ester, and other esters (G) Multifunctional additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound (H) Viscosity Index improvers: polymethacrylate type polymers, ethylene-propylene copolymers, styrene-isoprene copolymers, hydrated styrene-isoprene copolymers, polyisobutylene, and dispersant type viscosity index improvers.

(I) Pour point depressants: polymethyl methacrylate.

(K) Foam Inhibitors: alkyl methacrylate polymers and dimethyl silicone polymers.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Unless otherwise specified, all percentages are in weight percent.

Example 1

Preparation of an Overbased Alkaline Earth Metal Alkylhydroxybenzoate

A. Neutralization/Sulfurization

In a 4 liter reactor, 1500 g of alkylphenol having a molecular weight of 430 and prepared from mixtures of linear normal alpha olefins ($C_{20}$-$C_{28}$ alpha olefins from Chevron Philips Chemical Company (CPC) was added under agitation at about 20° C. to 60° C. To this, 750 g of xylene and 195.3 g of pure KOH diluted in water (in order to obtain 452.1 g of solution; 0.2 g of Rhodorsil 47V300 defoamer (commercialized by Rhodia) and 16.4 g of sulfur were added.

The reactor was then heated further to 145° C. over a period of about 2 hours, then gradually decreasing the atmospheric pressure (1013 mbar absolute $-1\times10^5$ Pa) to 800 mbar absolute ($8\times10^4$ Pa). Under these conditions, reflux was maintained for 3 hours and the vacuum was broken with nitrogen to decrease the pressure down to atmospheric pressure. The reactor was heated to about 200° C. over a period of one hour and held for 90 minutes at these conditions. A potassium alkylphenate containing 30% xylene was obtained and was stored under nitrogen.

B. Carboxylation 1100 g of the potassium alkylphenate obtained in the neutralization/sulfurization step A above was transferred to a pressurizable reactor. The reactor was then pressurized with $CO_2$ at about 4 bar ($4\times10^5$ Pa) (absolute pressure) and maintained under these conditions for about 4 hours. At the end of the period, $CO_2$ was vacated to allow the reactor to reach atmospheric pressure. 41 g of $CO_2$ was added and the mixture further reacted to yield a low sulfurized potassium alkylhydroxybenzoate reaction product having a sulfur content of about 0.33 wt %.

C. Acidification/Neutralization

The low sulfurized potassium alkylhydroxybenzoate was reacted with a 30 molar % excess of aqueous solution of sulfuric acid to convert it to a sulfurized alkylhydroxybenzoic acid as follows:

Calculation of Loads:

carboxylate: 1100 g (containing 30% xylene)

770 g of potassium salt (1.5 mole of potassium)

quantity of sulfuric acid required

98×1.504/2=73.7 g as purity of sulfuric acid is 95% and an excess of 30% is utilized: 100.8 g of sulfuric acid is loaded.

A mixture of 100.8 g of sulfuric acid at 95% and 907.2 g of water in order to obtain 1008 g of a solution of sulfuric acid diluted at 10% was placed in a 6 liter reactor and heated to 50° C. under agitation at 250 rpm. The low sulfurized potassium alkylhydroxybenzoate from step B above and xylene (970 g) were loaded over a period of 30 minutes. Xylene assisted in phase separation. The reactor was heated and maintained at 60° C. to 65° C. for 2 hours with continued agitation.

At the end of this period, agitation was stopped, but the reactor was maintained at 60° C. to 65° C. for 2 hours to allow the phase separation to occur. Upon phase separation, the lower aqueous phase which contains water and potassium sulfate was decanted.

The upper organic phase containing the low sulfurized alkylhydroxybenzoic acid and xylene were collected for the following step. The concentration of low sulfurized alkylhydroxybenzoic acid was determined as an equivalent of mg KOH/g.

D. Overbasing 1479 g of the upper organic phase containing the low sulfurized alkylhydroxybenzoic acid was loaded under agitation into a reactor over a 10 minutes period. Then a slurry of methanol (159 g), lime (159 g) and xylene (228 g) was introduced. Due to the exothermic reaction, temperature increased from about 20° C. to 28° C.

Once the slurry was added, the reactor was heated to 40° C. over a period of 30 minutes, and a mixture of formic acid (5.4 g):acetic acid (5.4 g) was added and allowed to react with the contents in the reactor. After a period of 5 minutes, the reactor was cooled to 30° C. over a period of 30 minutes. The reaction yielded a calcium alkylhydroxybenzoate reaction product.

Once the temperature of the reactor has cooled to 30° C., 46.6 g of $CO_2$ was introduced at a flow rate of 0.34 g/minute over a period of 137 minutes. The temperature increased from about 25° C. up to 40° C. The reaction yielded an overbased calcium alkylhydroxybenzoate reaction product having a sulfur content of about 0.30 wt %. The percentage of crude sediment (1.2% volume) was determined at this step following the ASTM D2273 method.

E. Predistillation, Centrifugation and Final Distillation

The mixture contained within the reactor was taken in stages to a temperature between 65° C. to 128° C. over a period of 110 minutes. This procedure removed methanol, water and a portion of the xylene. Once 128° C. was reacted, diluent oil of Group II having less than 0.03% of sulfur (161 g) was added. Crude sediment was then measured. The amount of crude sediment in the low sulfurized overbased calcium alkylhydroxybenzoate reaction product was 1.2 volume %. The reaction mixture was centrifuged to remove crude sediment and then distilled at 204° C. for 10 minutes under vacuum at 50 mbar absolute ($50\times10^2$ Pa) to remove the remaining xylene.

Loads are provided in Table II and analyses are shown in Table III.

Example 2

Similar to Example 1, except a somewhat higher quantity of sulfur was loaded at the neutralization step: 37 g instead of 16.4 g.

Loads are provided in Table II and analyses are shown in Table III.

Comparative Example A

Similar to Example 1, except a much higher quantity of sulfur was loaded at the neutralization step: 56.2 g instead of 16.4.

Loads are provided in Table II and analyses are shown in Table III.

Comparative Example B

Similar to Example 1 except no sulfur was added.

Loads are provided in Table II and analyses are shown in Table III.

The corrosion property of the alkylhydroxybenzoate reaction products were evaluated in the Copper Strip Corrosion Test as specified in ASTM D130. Crude petroleum contains sulfur compounds, most of which are removed during refining. However, of the sulfur compounds remaining in the petroleum product, some can have a corroding action on various metals and this corrosivity is not necessarily related directly to the total sulfur content. The effect can vary according to the chemical types of sulfur compounds present. The copper strip corrosion test is designed to assess the relative degree of corrosivity of a petroleum product. In this test, a polished copper strip is immersed in a specific volume of the sample being tested and heated under conditions of temperature and time that are specific to the class of material being tested. At the end of the heating period, the copper strip is removed, washed and the color and tarnish level assessed against the ASTM Copper Strip Corrosion Standard summarized below.

ASTM D130-04: Copper Strip Classifications

| Classification | Designation | Description[1] |
|---|---|---|
| Freshly polished strip[2] | | |
| 1 | slight tarnish | a. Light orange, almost the same as freshly polished strip |
| | | b. Dark Orange |
| 2 | moderate tarnish | a. Claret red |
| | — | b. Lavender |
| | — | c. Multicolored with lavender blue or silver or both, overlaid on claret red |
| | — | d. Silvery |
| | — | e. Brassy or gold |
| 3 | dark tarnish | a. Magenta overcast on brassy strip |
| | | b. Multicolored with red and green showing (peacock), but no gray |
| 4 | corrosion | a. Transparent black, dark gray or brown with peacock green barely showing |
| | | b. Glossy or jet black |

[1]The ASTM Copper Strip Corrosion Standard is a colored reproduction of strips characteristic of these descriptions.

[2]The freshly polished strip is included in the series only as an indication of the appearance of a properly polished strip before a test run; it is not possible to duplicate this appearance after a test even with a completely noncorrosive sample.

Performance Results

Differential scanning calorimeter.

Equipment DSC 2920 supplied by TA instruments.

Main Objective of this Test

Determine the oxidative properties of this product versus a sulfur free material.

Description of the Method

Oxidative properties were evaluated by a:

"differential calorimeter" in isotherm made at 190° C.

an aluminum pan containing the sample to be tested, is put on the probe.

oxidation of the sample is characterized by a quick increase of temperature detected by the probe.

the result is determined through the duration time of the sample (expressed in minutes) at the same temperature before the temperature increased due to the oxidation.

The higher is the number (expressed in minutes), the more resistant is the product to oxidation.

| | Example 2 | Comparative Example B |
|---|---|---|
| Duration (minutes) | 46.4 | 21 |

The introduction of some sulfur improved oxidative properties.

TABLE II

| LOADS | Example 1 | Example 2 | Comparative Example A | Comparative Example B |
|---|---|---|---|---|
| A. Neutralization Step Linear Alkylphenols | | | | |
| CPC $C_{20}$-$C_{28}$ Olefin (g) | 1500 | 1500 | 1500 | 1500 |
| CPC $C_{20}$-$C_{28}$ Olefin (mole) | 3.49 | 3.49 | 3.49 | 3.49 |
| KOH/Alkylphenol Molar Ratio (g) | 1 | 1 | 1 | 1 |
| Defoamer (g) | 0.2 | 0.2 | 0.2 | 0.2 |
| Xylene (g) | 750 | 750 | 750 | 750 |
| KOH (diluted at 45% water) (g) | 450 | 450 | 450 | 450 |
| KOH (diluted at 45% water) (mole) | 3.49 | 3.49 | 3.49 | 3.49 |
| Sulfur (g) | 16.4 | 37 | 56.2 | 0 |

TABLE II-continued

| LOADS | Example 1 | Example 2 | Comparative Example A | Comparative Example B |
|---|---|---|---|---|
| Water eliminated (g) | 325 | 325 | 325 | 325 |
| B. Carboxylation $CO_2$ (g) | 42 | 42 | 42 | 42 |
| C. Acidification | | | | |
| S-Carboxylate | 1100 | 1100 | 1100 | 1100 |
| Xylene (g) | 970 | 970 | 970 | 970 |
| Sulfuric acid at 45% (g) | 100.8 | 100.8 | 100.8 | 100.8 |
| Water (g) | 907.2 | 907.2 | 907.2 | 907.2 |
| D. Neutralization/Overbasing | | | | |
| S-Alkylhydroxybenzoic acid in xylene (g) | 1479 | 1838 | 2140 | 1351 |
| (mg KOH/g) | 31.7 | 25.5 | 21.9 | 34.7 |
| Slurry | | | | |
| Xylene (g) | 228 | 228 | 228 | 228 |
| Methanol (g) | 159 | 159 | 159 | 159 |
| Lime (g) | 159 | 159 | 159 | 159 |
| Formic acid (g) | 5.4 | 5.4 | 5.4 | 5.4 |
| Acetic acid (g) | 5.4 | 5.4 | 5.4 | 5.4 |
| $CO_2$ (g) | 46.6 | 46.6 | 46.6 | 46.6 |
| Diluent oil (g) | 161 | 161 | 230 | 230 |
| Sediment (% vol) at the end of carbonation as determined by ASTM D2273 | 1.2 | 1.2 | 1.2 | 1.0 |

TABLE III

| | Examples | | | |
|---|---|---|---|---|
| | 1 | 2 | Comp Ex. A | Comp Ex. B |
| Analysis | | | | |
| CaT(wt %) | 9.17 | 8.13 | 6.78 | 9.2 |
| Sulfur (wt %) | 0.39 | 0.94 | 1.54 | 0 |
| Viscosity at 100° C. $mm^2/s$ (ASTM D445) | 610 | 140 | 46 | 226 |
| BN calculated | 257 | 228 | 190 | 258 |
| Copper strip ASTM D130 | 1A | 1A | 2C | 1A |
| Sed (% vol) OPM287 | 0.02 | 0.08 | 0.12 | Traces |
| Composition thru dialysis | | | | |
| Alkylhydroxybenzoate reaction product (wt %) | 43.1 | 40.1 | 34.9 | 40.2 |
| alkylphenate (wt %) | 3.5 | 6 | 3.5 | 7 |
| unreacted alkylphenol (wt %) | 7.8 | 15.6 | 20.9 | 4.6 |
| calcium carbonate (wt %) | 22.3 | 15.8 | 13.2 | 18.1 |
| diluent oil (wt %) | 21.9 | 21.1 | 26.2 | 28.8 |
| Calcium formeate + calcium acetate (wt %) | 1.4 | 1.4 | 1.3 | 1.3 |
| % unreacted alkylphenol + alkylphenate | 20.8 | 35.0 | 41.1 | 11.6 |

Analytical Determination

A—Neutralization of Alkylphenol

Conversion % alkylphenols

In a first step, the product obtained at the end of step A is dialyzed through a membrane: the phenate salt stays inside the membrane and after elimination of the solvent, it is weighted (M1).

Xylene and the unreacted alkylphenol move through the membrane xylene and the solvents utilized are eliminated by vaporization, a weight M2 is obtained.

$$\% \text{ Conversion} = \frac{M1}{M1 + M2} \times 100$$

B. Carboxylation:

The product obtained at the end of step B is acidified by hydrochloric acid, it is titrated by tetra-n-butylammonium hydroxide.

Three inflexions points are observed:

The first two inflexion points (V1, V2) correspond to the hydroxybenzoic acid, dicarboxylic acids and sulfurized benzoic acids.

Third one V3 corresponds to alkylphenols+alkylphenate V1, V2, V3 are expressed in mg KOH/g of product.

C. Acidification Step Up Phase:

The level of hydroxybenzoic acid is determined through the method as above except no acidification by hydrochloric acid because the product has already been acidified by sulfuric acid.

Composition through dialysis

The method is the following:

1°) Dialysis of the final material

A "residue" (calcified part) stays inside the membrane

Dialysate: non calcified part (unreacted alkylphenol and diluent oil) moves through the membrane 2°) Analysis of residue It contained calcium carbonate, Ca phenate, Ca sulfurized phenate, Ca hydroxybenzoate and sulfurized Ca hydroxybenzoate. After elimination of solvent, the residue is weighted. After acidification, the quantity of phenate and hydroxybenzoate are determined through a potentiometric method.

Determination of calcium carbonate. A known quantity of final product is acidified, the organic phase contains hydroxybenzoic acid, alkylphenol and sulfurized derivatives thereof. After elimination of solvent (of this organic phase), the quantity of calcium carbonate is obtained by difference: weight of starting sample minus weight of this organic phase after elimination of solvent and correction.

3°) Analysis of dialysate

Diluent oil and alkylphenols go through a silica column to separate alkylphenols and diluent oil. Quantity of alkylphenols is determined by difference of weight.

The results shown on Table III demonstrate that Examples 1 and 2 of the present invention, having a lower sulfur wt %, show significantly reduced levels of sediment and copper corrosion than comparative Example A. Having low sulfur (Example 2) also provides improved oxidation resistance as compared to no sulfur (Comparative Example B).

What is claimed is:

1. A process for preparing an alkali metal alkylhydroxybenzoate reaction product, said process comprising: a) neutralizing at least one alkylphenol with an alkali metal base to form an alkali metal alkylphenate; and b) carboxylating the alkali metal alkylphenate with carbon dioxide to obtain an alkali metal alkylhydroxybenzoate reaction product; wherein at least one of the alkylphenol, alkylphenate and alkylhydroxybenzoate is reacted with a sulfur source to achieve a sulfur content in the range of about 0.1 to 1.2 wt % in the alkali metal alkylhydroxybenzoate reaction product, and wherein at least 50 mole % of the starting alkylphenol is converted to the alkali metal alkylhydroxybenzoate reaction product.

2. The process according to claim 1, wherein the alkyl group of the alkylphenol is a linear or branched alkyl group or a mixture of linear and branched alkyl groups.

3. The process according to claim 2, wherein the alkyl group of the alkylphenol is a linear alkyl group having from about 12 to 40 carbon atoms.

4. The process according to claim 3, wherein the alkyl group of the alkylphenol is a linear alkyl group having from about 20 to 40 carbon atoms.

5. The process according to claim 4, wherein the alkyl group of the alkylphenol is a linear alkyl group having from about 22 to 30 carbon atoms.

6. The process according to claim 2, wherein the alkyl group of the alkylphenol is a branched alkyl group having at least 9 carbon atoms.

7. The process according to claim 6, wherein the alkyl group of the alkylphenol is a branched alkyl group having from about 9 to 24 carbon atoms.

8. The process according to claim 7, wherein the alkyl group of the alkylphenol is a branched alkyl group having from about 10 to 18 carbon atoms.

9. The process according to claim 2, wherein the alkyl group of the alkylphenol is a mixture of linear and branched alkyl groups.

10. The process according to claim 9, wherein the alkyl group contains up to 85 wt % linear alkylphenol in mixture with at least 15 wt % of branched alkylphenol.

11. The process according to claim 2, wherein the alkyl group of the alkylphenol is selected from the group consisting of a linear $C_{14}$-$C_{16}$ alkyl, $C_{16}$-$C_{18}$ alkyl, $C_{18}$-$C_{20}$ alkyl, $C_{20}$-$C_{22}$ alkyl, $C_{20}$-$C_{24}$ alkyl, $C_{20}$-$C_{28}$ alkyl, and mixtures thereof.

12. The process according to claim 1, wherein the alkali metal is sodium or potassium.

13. The process according to claim 12, wherein the alkali metal is potassium.

14. The process according to claim 1, wherein the sulfur source is selected from the group consisting of elemental sulfur and sulfur halides.

15. The process according to claim 14, wherein the sulfur source is elemental sulfur.

16. The process according to claim 1, wherein the sulfur content is in the range of about 0.1 to 1.0 wt % in the alkali metal alkylhydroxybenzoate reaction product.

17. The process according to claim 16, wherein the sulfur content is the range of about 0.1 to 0.5 wt % in the alkali metal alkylhydroxybenzoate reaction product.

18. A process for preparing an alkaline earth metal alkylhydroxybenzoate reaction product, said process comprising: a) neutralizing at least one alkylphenol with an alkali metal base to form an alkali metal alkylphenate; b) carboxylating the alkali metal alkylphenate with carbon dioxide to obtain an alkali metal alkylhydroxybenzoate; and c) acidifying the alkali metal alkylhydroxybenzoate to form the alkylhydroxybenzoic acid, and further reacting the alkylhydroxybenzoic acid with a molar excess of an alkaline earth metal base to form an alkaline earth metal alkylhydroxybenzoate reaction product; wherein at least one of the alkylphenol, alkylphenate, alkylhydroxybenzoic acid, alkali metal alkylhydroxybenzoate and alkaline earth metal alkylhydroxybenzoate is reacted with a sulfur source to achieve a sulfur content in the range of about 0.1 to 1.2 wt % in the alkaline earth metal alkylhydroxybenzoate reaction product, and wherein at least 50 mole % of the starting alkylphenol is converted to the alkaline earth metal alkylhydroxybenzoate reaction product.

19. The process according to claim 18, wherein the alkyl group of the alkylphenol is a linear or branched alkyl group or a mixture of linear and branched alkyl groups.

20. The process according to claim 19, wherein the alkyl group of the alkylphenol is a linear alkyl group having from about 12 to 40 carbon atoms.

21. The process according to claim 20, wherein the alkyl group of the alkylphenol is a linear alkyl group having from about 20 to 40 carbon atoms.

22. The process according to claim 21, wherein the alkyl group of the alkylphenol is a linear alkyl group having from greater than about 22 to 30 carbon atoms.

23. The process according to claim 18, wherein the alkyl group of the alkylphenol is a branched alkyl group having at least 9 carbon atoms.

24. The process according to claim 23, wherein the alkyl group of the alkylphenol is a branched alkyl group having from about 9 to 24 carbon atoms.

25. The process according to claim 24, wherein the alkyl group of the alkylphenol is a branched alkyl group having from about 10 to 18 carbon atoms.

26. The process according to claim 20, wherein the alkyl group of the alkylphenol is a mixture of linear and branched alkyl groups.

27. The process according to claim 26, wherein the alkylphenol contains up to 85 wt % linear alkylphenol in mixture with at least 15 wt % of branched alkylphenol.

28. The process according to claim 19, wherein the alkyl group of the alkylphenol is selected from the group consisting of a linear $C_{14}$-$C_{16}$ alkyl, $C_{16}$-$C_{18}$ alkyl, $C_{18}$-$C_{20}$ alkyl, $C_{20}$-$C_{22}$ alkyl, $C_{20}$-$C_{24}$ alkyl, $C_{20}$-$C_{28}$ alkyl, and mixtures thereof.

29. The process according to claim 18, wherein the alkali metal is sodium or potassium.

30. The process according to claim 29, wherein the alkali metal is potassium.

31. The process according to claim 18, wherein the alkaline earth metal is calcium or magnesium.

32. The process according to claim 31, wherein the alkaline earth metal is calcium.

33. The process according to claim 18, wherein the sulfur source is selected from the group consisting of elemental sulfur and sulfur halides.

34. The process according to claim 33, wherein the sulfur source is elemental sulfur.

35. The process according to claim 18 wherein the sulfur content is in the range of about 0.1 to 1.0 wt % in the alkaline earth metal alkylhydroxybenzoate reaction product.

36. The process according to claim 35, wherein the sulfur content is the range of about 0.1 to 0.5 wt % in the alkaline earth metal alkylhydroxybenzoate reaction product.

37. A process for preparing an overbased alkaline earth metal alkylhydroxybenzoate reaction product, said process comprising: a) neutralizing at least one alkylphenol with an alkali metal base to form an alkali metal alkylphenate; b) carboxylating the alkali metal alkylphenate with carbon dioxide to obtain an alkali metal alkylhydroxybenzoate; acidifying the alkali metal alkylhydroxybenzoate to form the alkylhydroxybenzoic acid, and further reacting the alkylhydroxybenzoic acid with an alkaline earth metal base to form an alkaline earth metal alkylhydroxybenzoate; and d) overbasing the alkaline earth metal alkylhydroxybenzoate with an alkaline earth metal base and at least one acidic overbasing material to form an overbased alkaline earth metal alkylhydroxybenzoate reaction product; wherein at least one of the alkylphenol, alkylphenate, alkylhydroxybenzoic acid, alkali metal alkylhydroxybenzoate and alkaline earth metal alkylhydroxybenzoate or overbased derivatives thereof is reacted with a sulfur source to achieve a sulfur content in the range of about 0.1 to 1.2 wt % in the overbased alkaline earth metal alkylhydroxybenzoate reaction product, and wherein at least 50 mole % of the starting alkylphenol is converted to the overbased alkaline earth metal alkylhydroxybenzoate reaction product.

38. The process according to claim 37, wherein the alkyl group of the alkylphenol is a linear or branched alkyl group or a mixture of linear and branched alkyl groups.

39. The process according to claim 38, wherein the alkyl group of the alkylphenol is a linear alkyl group having from about 12 to 40 carbon atoms.

40. The process according to claim 37, wherein the alkyl group of the alkylphenol is a linear alkyl group having from about 20 to 40 carbon atoms.

41. The process according to claim 38, wherein the alkyl group of the alkylphenol is a linear alkyl group having from greater than about 22 to 30 carbon atoms.

42. The process according to claim 38, wherein the alkyl group of the alkylphenol is a branched alkyl group having at least 9 carbon atoms.

43. The process according to claim 42, wherein the alkyl group of the alkylphenol is a branched alkyl group having from about 9 to 24 carbon atoms.

44. The process according to claim 43, wherein the alkyl group of the alkylphenol is a branched alkyl group having from about 10 to 18 carbon atoms.

45. The process according to claim 38, wherein the alkyl group of the alkylphenol is a mixture of linear and branched alkyl.

46. The process according to claim 45, wherein the alkylphenol contains up to 85 wt % linear alkylphenol in mixture with at least 15 wt % of branched alkylphenols.

47. The process according to claim 46, wherein the alkyl group of the alkylphenol is selected from the group consisting of a linear $C_{14}$-$C_{16}$ alkyl, $C_{16}$-$C_{18}$ alkyl, $C_{18}$-$C_{20}$ alkyl, $C_{20}$-$C_{22}$ alkyl, $C_{20}$-$C_{24}$ alkyl, $C_{20}$-$C_{28}$ alkyl, and mixtures thereof.

48. The process according to claim 37, wherein the alkali metal is sodium or potassium.

49. The process according to claim 48, wherein the alkali metal is potassium.

50. The process according to claim 37 wherein the alkaline earth metal is calcium or magnesium.

51. The process according to claim 50, wherein the alkaline earth metal is calcium.

52. The process according to claim 37, wherein the sulfur source is selected from the group consisting of elemental sulfur and sulfur halides.

53. The process according to claim 52, wherein the sulfur source is elemental sulfur.

54. The process according to claim 37, wherein the sulfur content is in the range of about 0.1 to 1.0 wt %, in the overbased alkali metal alkylhydroxybenzoate reaction product.

55. The process according to claim 54, wherein the sulfur content is the range of about 0.1 to 0.5 wt % in the overbased alkaline earth metal alkylhydroxybenzoate reaction product.

56. The process according to claim 37, wherein the TBN is from about 20 to 500.

57. The process according to claim 54, wherein the TBN is from about 100 to 400.

58. The process according to claim 57, wherein the TBN is from about 150 to 300.

59. A product prepared by the process comprising: a) neutralizing at least one alkylphenol with an alkali metal base to form an alkali metal alkylphenate; and b) carboxylating the alkali metal alkylphenate with carbon dioxide to obtain an alkali metal alkylhydroxybenzoate reaction product; wherein at least one of the alkylphenol, alkylphenate and alkylhydroxybenzoate is reacted with a sulfur source to achieve a sulfur content in the range of about 0.1 to 1.2 wt % in the alkali metal alkylhydroxybenzoate reaction product, and wherein at least 50 mole % of the starting alkylphenol is converted to the alkali metal alkylhydroxybenzoate reaction product.

60. A product produced by the process comprising: a) neutralizing at least one alkylphenol with an alkali metal base to form an alkali metal alkylphenate; b) carboxylating the alkali metal alkylphenate with carbon dioxide to obtain an alkali metal alkylhydroxybenzoate; and c) acidifying the alkali metal alkylhydroxybenzoate to form the alkylhydroxybenzoic acid, and further reacting the alkylhydroxybenzoic acid with a molar excess of an alkaline earth metal base to form an alkaline earth metal alkylhydroxybenzoate reaction product; wherein at least one of the alkylphenol, alkylphenate, alkylhydroxybenzoic acid, alkali metal alkylhydroxybenzoate and alkaline earth metal alkylhydroxybenzoate is reacted with a sulfur source to achieve a sulfur content in the range of about 0.1 to 1.2 wt % in the alkaline earth metal alkylhydroxybenzoate reaction product, and wherein at least 50 mole % of the starting alkylphenol is converted to the alkaline earth metal alkylhydroxybenzoate reaction product.

61. A product produced by the process comprising: a) neutralizing at least one alkylphenol with an alkali metal base to form an alkali metal alkylphenate; b) carboxylating the alkali metal alkylphenate with carbon dioxide to obtain an alkali metal alkylhydroxybenzoate; c) acidifying the alkali metal alkylhydroxybenzoate to form the alkylhydroxybenzoic acid, and further reacting the alkylhydroxybenzoic acid with an alkaline earth metal base to form an alkaline earth metal alkylhydroxybenzoate; and d) overbasing the alkaline earth metal alkylhydroxybenzoate with an alkaline earth metal base and at least one acidic overbasing material to form an overbased alkaline earth metal alkylhydroxybenzoate reaction product; wherein at least one of the alkylphenol, alkylphenate, alkylhydroxybenzoic acid, alkali metal alkylhydroxybenzoate and alkaline earth metal alkylhydroxybenzoate or overbased derivatives thereof is reacted with a sulfur source to achieve a sulfur content in the range of about 0.1 to 1.2 wt % in the overbased alkaline earth metal alkylhydroxybenzoate reaction product, and wherein at least 50 mole % of the starting alkylphenol is converted to the overbased alkaline earth metal alkylhydroxybenzoate reaction product.

62. A lubricating oil composition comprising: a) a major amount of base oil of lubricating viscosity and b) a minor amount of an alkali metal alkylhydroxylbenzoate reaction product obtained by the process comprising the steps of: i) neutralizing at least one alkylphenol with an alkali metal base to form an alkali metal alkylphenate; and ii) carboxylating the alkali metal alkylphenate with carbon dioxide to obtain an alkali metal alkylhydroxybenzoate reaction product; wherein at least one of the alkylphenol, alkylphenate, and alkylhydroxybenzoate is reacted with a sulfur source to achieve a sulfur content in the range of about 0.1 to 1.2 wt % in the alkali metal alkylhydroxybenzoate reaction product, and wherein at least 50 mole % of the starting alkylphenol is converted to the alkali metal alkylhydroxybenzoate reaction product.

63. A lubricating oil composition comprising: a) a major amount of base oil of lubricating viscosity and b) a minor amount of an alkaline metal alkylhydroxylbenzoate reaction product obtained by the process comprising the steps of: i) neutralizing at least one alkylphenol with an alkali metal base to form an alkali metal alkylphenate; ii) carboxylating the alkali metal alkylphenate with carbon dioxide to obtain an alkali metal alkylhydroxybenzoate; and iii) acidifying the alkali metal alkylhydroxybenzoate to form the alkylhydroxybenzoic acid, and further reacting the alkylhydroxybenzoic acid with an alkaline earth metal base to form an alkaline earth metal alkylhydroxybenzoate reaction product; wherein at least one of the alkylphenol, alkylphenate, alkylhydroxybenzoic acid, alkali metal, alkylhydroxybenzoate and alkaline earth metal alkylhydroxybenzoate is reacted with a sulfur source to achieve a sulfur content in the range of about 0.1 to 1.2 wt % in the alkaline earth metal alkylhydroxybenzoate reaction product, and wherein at least 50 mole % of the starting alkylphenol is converted to the alkaline earth metal alkylhydroxybenzoate reaction product.

64. A lubricating oil composition comprising: a) a major amount of base oil of lubricating viscosity and b) a minor amount of an overbased alkaline metal alkylhydroxylbenzoate reaction product obtained by the process comprising the steps of: i) neutralizing at least one alkylphenol with an alkali metal base to form an alkali metal alkylphenate; ii) carboxylating the alkali metal alkylphenate with carbon dioxide to obtain an alkali metal alkylhydroxybenzoate; iii) acidifying the alkali metal alkylhydroxybenzoate to form the alkylhydroxybenzoic acid, and further reacting the alkylhydroxybenzoic acid with an alkaline earth metal base to form an alkaline earth metal alkylhydroxybenzoate reaction product; and iv) overbasing the alkaline earth metal alkylhydroxybenzoate with an alkaline earth metal base and at least one acidic overbasing material to form an overbased alkaline earth metal alkylhydroxybenzoate reaction product; wherein at least one of the alkylphenol, alkylphenate, alkylhydroxybenzoic acid, alkali metal, alkylhydroxybenzoate and alkaline earth metal alkylhydroxybenzoate or overbased derivatives thereof is reacted with a sulfur source to achieve a sulfur content in the range of about 0.1 to 1.2 wt % in the overbased alkaline earth metal alkylhydroxybenzoate reaction product, and wherein at least 50 mole % of the starting alkylphenol is converted to the overbased alkaline earth metal alkylhydroxybenzoate reaction product.

65. A method of improving anti-corrosion properties in an internal combustion engine, said method comprising operating the material combustion engine with the lubricating oil composition of claim 62.

66. A method of improving anti-corrosion properties in an internal combustion engine, said method comprising operating the internal combustion engine with the lubricating oil composition of claim 63.

67. A method of improving anti-corrosion properties in an internal combustion engine, said method comprising operating the internal combustion engines with the lubricating oil composition of claim 64.

* * * * *